US005436605A

United States Patent [19]

Mrenna

[11] Patent Number: 5,436,605

[45] Date of Patent: Jul. 25, 1995

[54] HANDLE BARRIER IN A MOLDED CASE FOR A MINIATURE CIRCUIT BREAKER

[75] Inventor: Stephen A. Mrenna, Brighton Township, Beaver County, Pa.

[73] Assignee: Eaton Corporation, Cleveland, Ohio

[21] Appl. No.: 257,988

[22] Filed: Jun. 10, 1994

[51] Int. Cl.[6] ..... H01H 9/02

[52] U.S. Cl. ..... 335/202; 200/302.1

[58] Field of Search ..... 200/293, 293.1, 302.1, 200/302.3, 303, 304, 305; 333/202; 335/8–10, 35, 23–25

[56] References Cited

U.S. PATENT DOCUMENTS

| | | | |
|---|---|---|---|
| 4,077,024 | 2/1978 | Lisnay | 335/8 |
| 4,843,359 | 6/1989 | Morris et al. | 335/6 |
| 4,879,535 | 11/1989 | Mori et al. | 334/14 |
| 4,933,653 | 6/1990 | Mrenna et al. | 335/37 |
| 5,008,645 | 4/1991 | Mrenna | 337/70 |
| 5,245,302 | 9/1993 | Brune et al. | 335/35 |

*Primary Examiner*—Lincoln Donovan

*Attorney, Agent, or Firm*—Martin J. Moran

[57] ABSTRACT

A case for a circuit breaker provides a base and a cover, both having an inner surface ribbing system and an inner surface coring system. The ribbing systems form an inner cavity retaining a circuit breaker mechanism and an outer aperture area for receiving a handle for manual operation of the mechanism. The handle is supported in the arcuate areas of the coring systems near the aperture area. A barrier member is located adjacent to the arcuate area in the base, and a barrier member is located adjacent to the arcuate area in the cover. When the base and the cover are assembled the two barrier members are spaced away from the handle and overlap the handle in the arcuate areas to separate the outer aperture area containing the handle from the inner cavity containing the circuit breaker mechanism and still allow the handle to extend freely down into the inner cavity for its connection to and operation of the circuit breaker mechanism. The width or thickness of the barrier member in the base is about 0.125 inches and that in the cover is about 0.156 inches.

18 Claims, 4 Drawing Sheets

FIG. 3
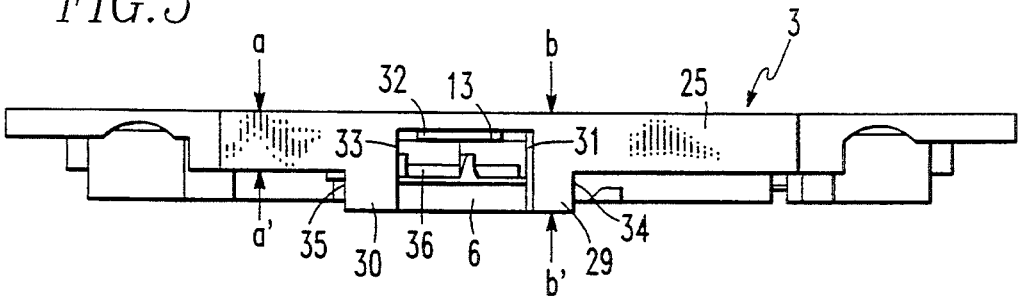
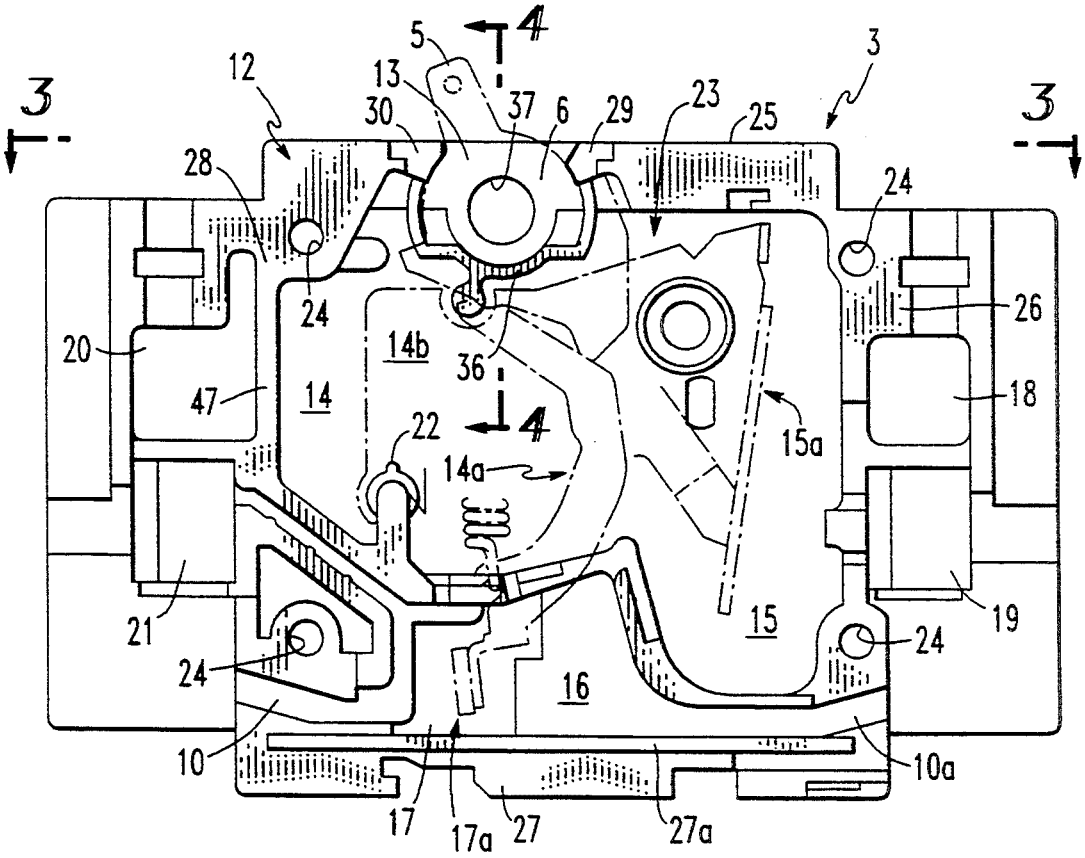
FIG. 2

FIG. 6
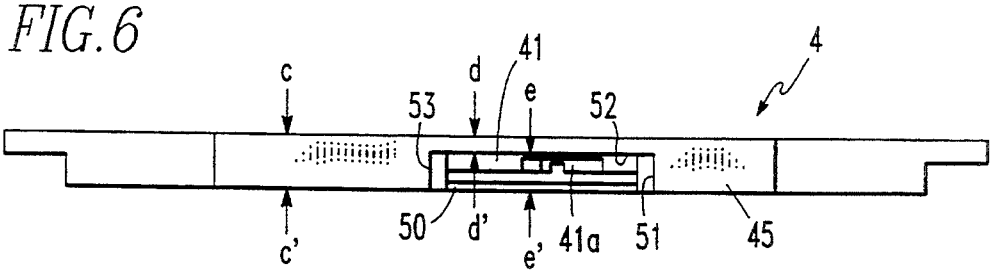
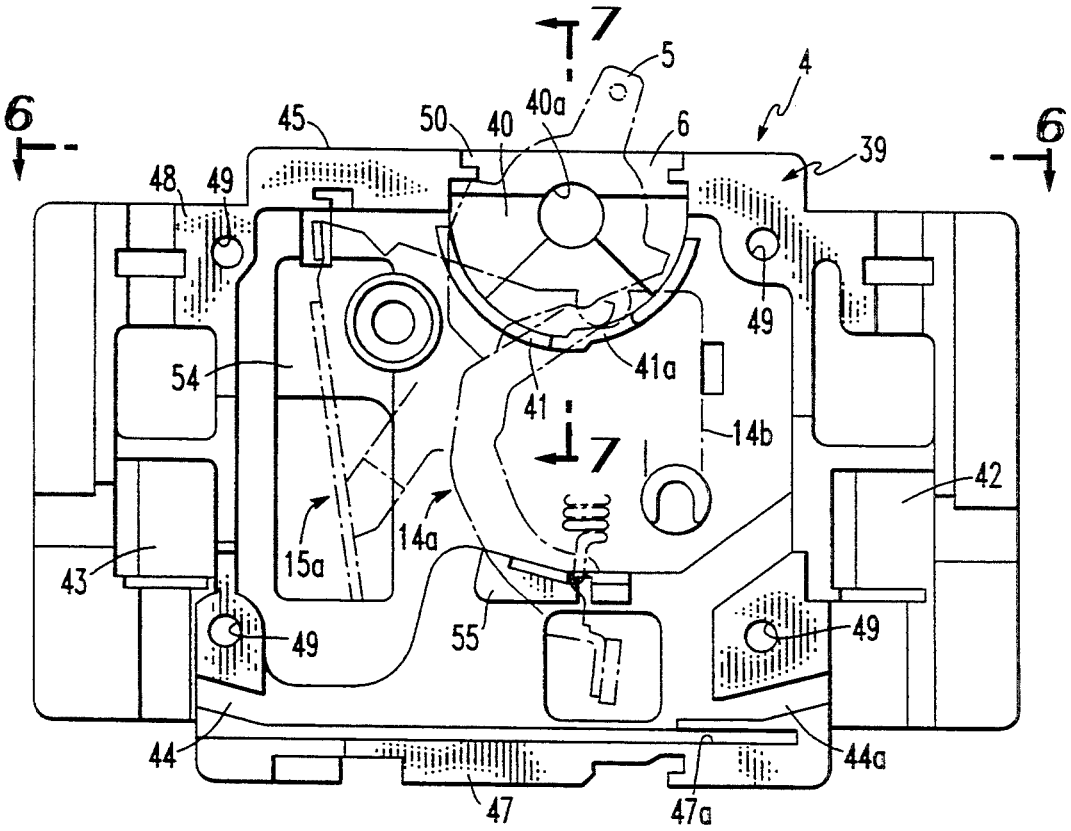
FIG. 5

HANDLE BARRIER IN A MOLDED CASE FOR A MINIATURE CIRCUIT BREAKER

CROSS REFERENCE TO RELATED APPLICATION

The invention taught herein is related to a concurrently filed, commonly assigned pending application Ser. No. 08/257,987 entitled "Molded Case For a Miniature Circuit Breaker" by Stephen A. Mrenna, et al.

BACKGROUND OF THE INVENTION

1. Field of the Invention

This invention relates to a miniature circuit breaker, and more particularly, to a molded case with a barrier member in both the base and in the cover which separates the inner cavity from the aperture area containing a handle part for manual operation of the circuit breaker.

2. Background Information

Present designs for a molded case for a miniature circuit breaker take various forms for forming and accommodating the handle part of a circuit breaker mechanism. Several of these designs provide coring for an arcuate area on the inner surface of both the base and the cover near an aperture for a handle, which aperture is in the peripheral walls of the case, and which walls and aperture are part of ribbing systems of the base and the cover. The walls form a cavity for carrying a circuit breaker mechanism. The arcuate coring area in both the base and in the cover corresponds to the surface and shape of a rounded end portion of the handle such that each side of the handle fits into and is supported by one of these arcuate areas in a manner that the handle projects from the aperture and is easily moved into its various positionings during operation of the circuit breaker mechanism.

Some of these present molded case designs for a miniature circuit breaker may include a barrier member in at least the cover, and a barrier member on the handle relative to the base, but these designs are more suitable for circuit breakers which have an overall thickness of about 1.000 inch. These present day designs for a barrier member prove to be inadequate for circuit breakers having an overall thickness of about 0.500 inches. If used in the thinner circuit breakers, a wide clearance may exist between the aperture for the handle and the main cavity, creating an unsafe condition especially when a short circuit occurs and an arc is formed in the cavity where the arc and associated gases can escape from the handle aperture.

There remains a need, therefore, for an improved case design for a miniature circuit breaker which minimizes the clearances in the handle aperture and which optimizes the safety factor for miniature circuit breakers.

SUMMARY OF THE INVENTION

This and other needs are satisfied by the present invention which provides a case having a base and a cover with inner surface ribbing and coring systems, whereby the ribbing systems include a peripheral wall forming an aperture means for receiving a handle for operating the circuit breaker mechanism, and the coring systems of each case part includes an arcuate area adjacent to the handle aperture means. This arcuate area corresponds to the outer surface features and the bearing side surfaces of the rounded end portion of the handle and receives and positions this rounded end of the handle in the assembled base and the cover so that the handle moves freely and easily into its several operating positionings.

An arcuate barrier member is part of the coring system of both the base and the cover and is spaced away from the aperture means and adjacent to the arcuate area. Each arcuate barrier member has a continuous arcuate width, and when the circuit breaker mechanism is installed in the base with the one side of the rounded end portion of the handle fitting into the respective arcuate coring area in the base, and the cover is installed onto the base, the two barrier members are spaced away from and overlap the rounded end portion of the handle allowing the handle to freely extend down into the main cavity for its connection to and operation of the circuit breaker mechanism in the main cavity formed by the assembled base and cover. This results in the handle and the barrier members cooperating to separate the handle aperture area from the main cavity containing the circuit breaker mechanism.

It is therefore an object of the present invention to provide an improved case design for a miniature circuit breaker having a thinner overall thickness than previous circuit breakers which reduces the risk for the escape of hot gases through a handle aperture when a short circuit or an are interruption occurs.

It is a further object of the present invention to provide a case for a circuit breaker having barrier members around the handle and its aperture which reduces the escape of hot gases therefrom during a short circuit or are interruption occurring in the circuit breaker.

A still further object of the present invention is to provide an arcuate barrier member in a base and in a cover of a molded case for a circuit breaker which are located in close proximity to a pivotally mounted handle extending through an aperture in the case.

A further object of the present invention is to provide an improved case design for a circuit breaker which provides very close tolerances in the handle aperture, thereby eliminating or reducing any openings or gaps between the handle aperture and the main cavity when an are interruption occurs.

These and other objects of the present invention will be more fully understood and appreciated from the following description of the invention, on reference to the illustrations appended hereto.

BRIEF DESCRIPTION OF THE DRAWINGS

FIG. 2 is a front elevational view showing the inside of the base of FIG. 1;

FIG. 3 is a side elevational view taken along lines 3—3 of FIG. 2;

FIG. 5 is a front elevational view showing the inside of the cover of FIG. 1;

FIG. 6 is a side elevational view taken along lines 6—6 of FIG. 5;

DESCRIPTION OF THE PREFERRED EMBODIMENT

Figure 1:
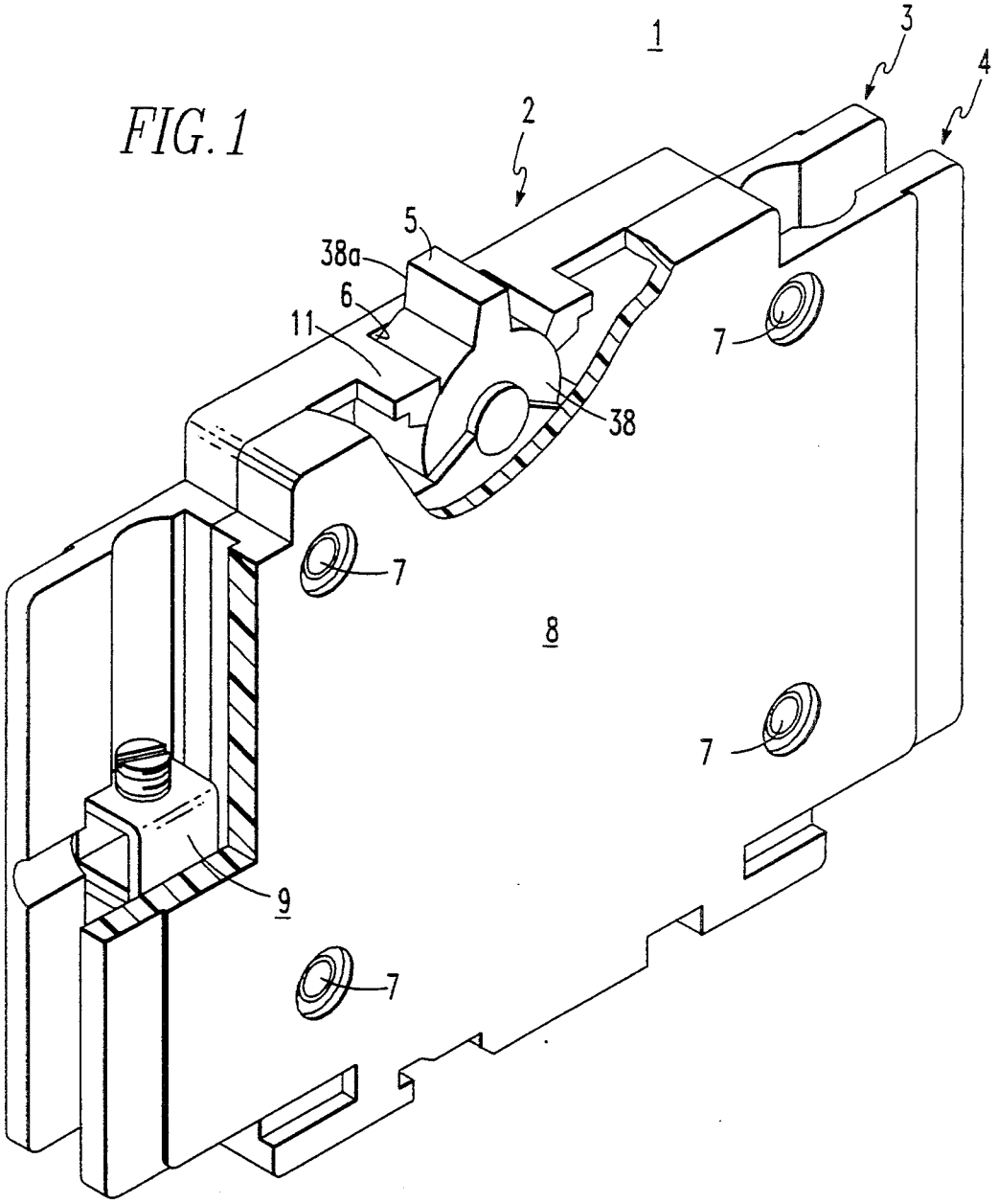
FIG. 1 is a perspective view, partly broken away, of a circuit breaker having a base and a cover which the present invention is incorporated.

Referring first to FIG. 1, the present invention is incorporated in a miniature circuit breaker 1 in which a circuit breaker mechanism is housed in an electrically insulating case 2 which is comprised of a molded insulating base 3 and a molded insulating cover 4, and which circuit breaker mechanism (not shown) is manually operated by a handle part 5 projecting through an aperture 6 formed by base 3 and cover 4. Cover 4 is attached to base 3 by rivets 7 which are recessed in both the cover 4 and the base 3.

This circuit breaker 1 of FIG. 1 is relatively thin with an overall case thickness of about 0.490 inch. The outer surface 8 of cover 4 is relatively smooth and free of any coring. Even though not shown, the top outer surface of base 3 is also relatively smooth and free of any coring. This feature of the outer surfaces of base 3 and cover 4, along with the relatively thin dimension of case 2 of circuit breaker 1 allows at least two single pole miniature circuit breakers to be compactly arranged in a given amount of space such as in a load center as compared to only one single pole miniature circuit breaker of the prior art which has outer surface coring and an overall thickness of about 1.000 inch.

As is also shown in FIG. 1, the design of case 2 for circuit breaker 1 positions the electrical terminals, one of which is indicated at numeral 9 relatively outside of the case 2. Handle part 5 extends through aperture 6 in an aperture area 11 of base 3 on top of case 2 to enable manual actuation of the circuit breaker mechanism of circuit breaker 1.

The circuit breaker 1 is of the type with a current interrupting rating of 10,000 amperes at 120/240 volts AC.

Figure 4:
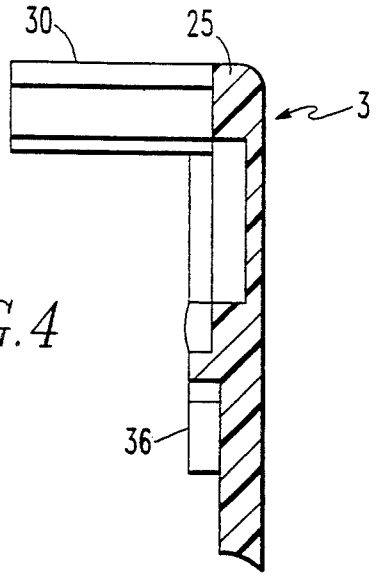
FIG. 4 is an enlarged, fractional cross-sectional view taken along lines 4—4 of FIG. 2.

Referring now to FIGS. 2, 3 and 4, base 3 is shown prior to the components of a circuit breaker mechanism (not shown) being installed. Base 3 is a molded one-piece member with an integrally formed, raised ribbing system 12 on its inner surface which, as is known in the art, generally forms a cavity for the circuit breaker mechanism and includes portions for supporting and/or forming different areas such as that indicated at numerals 13, 14, 15, 16, 17, 18, 19, 20 and 21 for receiving and positioning the several components of the circuit breaker mechanism, only some of which components are shown in phantom in FIG. 2 for clarity purposes. For instance, the arcuate area 13 positions the handle part 5 of FIG. 1. Area 14 positions a latchable operating mechanism **14*a* which is spring biased to the handle part 5 and a stationary support plate 14*b* which is supported on post 22 which is part of ribbing system 12. Area 15 supports a cradle 15*a*. Areas 19 and 21 position the load and line electrical terminals, one indicated at 9 in FIG. 1. Area 17 receives a set of electrical contacts 17*a* for the load and line terminals and a metallic shield for the arc interruption. These and other components of the circuit breaker mechanism are assembled and placed in the several areas formed by the ribbing system 12** in a manner similar to that shown in U.S. Pat. Nos. 4,933,653 and 5,008,645 assigned to the same assignee as this application, which U.S. Pat. Nos. 4,933,653 and 5,008,645 are incorporated herein by reference.

Ribbing system 12 also forms channels or gas vents 10 and **10*a* below each of the electrical terminals (one indicated at numeral 9 in FIG. 1) for the escape of gases into the atmosphere. Ribbing system 12 includes outer peripheral walls which essentially form inner cavity 23 for the circuit breaker mechanism, and which contain apertures 24 for receiving rivets 7 of FIG. 1**.

The configuration of outer peripheral wall 25 from which handle part 5 protrudes is best shown in FIG. 2. The width of peripheral wall 25 is generally the same dimension as the rest of the peripheral walls 26, 27 and 28 of base 3 forming inner cavity 23 except for the increased or enlarged portions 29 and 30 which are part of an enlarged area of peripheral wall 25 and which portions 29 and 30 form aperture 6. Aperture 6 is a generally rectangular opening, and has inner surfaces 31, 32 and 33, and the enlarged area of portions 29 and 30 has outer surfaces 34 and 35.

As particularly shown in FIG. 2, the ribbing system 12 of base 3 further includes an internally formed arcuate barrier member 36 which is positioned adjacent to and borders and forms arcuate area 13. Arcuate area 13 has a generally circular coring area 37 which is inwardly of the surface of arcuate area 13. The configuration of coring area 37 and arcuate area 13 correspond to beating surface **38*a* of handle part 5 opposite and similar to that shown at numeral 38 in FIG. 1**.

With particular reference to FIGS. 2 and 3, barrier member 36 is located inwardly of peripheral wall 25 and handle aperture 6, and adjacent to arcuate area 13. As shown, the thickness or width of barrier member 36 is less than that of peripheral walls 25, 26, 27 and 28, and preferably, is about 0.125 inches, or may range from about 0.120 inches to about 0.130 inches. FIG. 4, in particular, shows the thickness for barrier member 36 relative to enlarged portion 30 of peripheral wall 25.

Referring to FIG. 3, the width of peripheral wall 25 indicated by a–a′ is about 0.245 inches, and the width of enlarged portions 29 and 30 as indicated by b–b′ is about 0.450. The remaining peripheral walls 26, 27 and 28 around cavity 23 (FIG. 2) terminate into mating surfaces (not numbered) and the width of these peripheral walls 26, 27 and 28 are about 0.245, essentially the same as that of peripheral wall 25 at a–a′. Peripheral wall 27 also has an elongated tongue member **27*a*** extending along its length.

Figure 7:
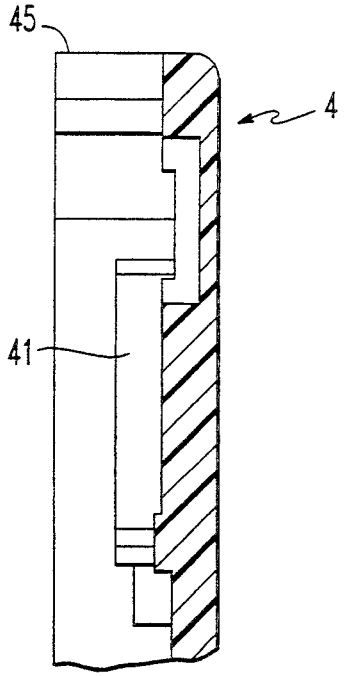
FIG. 7 is an enlarged, fractional cross-sectional view taken along lines 7—7 of FIG. 5.

FIGS. 5, 6 and 7 illustrate cover 4 prior to its being attached to base 3 once the components of the circuit breaker mechanism have been assembled and fixed in base 3. Cover 4 is a molded one-piece member with an integrally formed, raised ribbing system 39 on its inner surface which has parts which correspond to and cooperate with those of the fibbing system 12 of base 3 of FIGS. 2, 3 and 4 to form the cavity and compartments for receiving and positioning the several components of the circuit breaker mechanism. For instance, arcuate area 40 including coring **40*a* and a barrier member 41 aid in receiving beating surface 38 of handle part 5. Areas 42 and 43 aid in holding the electrical terminals, one shown at 9 in FIG. 1, and passageways 44 and 44*a* cooperate with base 3 to form channels 10 and 10*a*, respectively, of FIG. 2**.

Ribbing system 39 of cover 4 includes outer peripheral walls 45, 46, 47 and 48, which contain apertures 49 for receiving rivets 7 of FIG. 1, and which cooperate with the outer peripheral walls 25, 26, 27 and 28 respectively, of base 3 to form and enclose the cavity 23 of base 3 containing the circuit breaker mechanism, some of which components are shown in phantom and which are those components shown in base 3 of FIG. 2.

The configuration of outer peripheral wall 45 of cover 4, which cooperates with outer peripheral wall 25 of base 3 of FIGS. 2 and 3 is shown in FIG. 6. The width of outer peripheral wall 45 is generally the same dimension as the remaining peripheral walls 46, 47 and 48 except for a recessed area 50, which generally forms a rectangular opening having inner surfaces 51, 52 and 53.

An additional portion for the ribbing system 39 of cover 4 is indicated at numeral 55 in FIG. 5. In referring particularly to FIG. 6, the width of outer peripheral wall 45 indicated at c–c' is about 0.245 inches. The width of outer peripheral wall 35 at the recessed area 50 indicated at d–d' is about 0.080 inches, and the width of the recessed area at e–e' is about 0.165 inches. The remaining outer peripheral walls 46, 47 and 48 of cover 4 are also about 0.245 inches wide and terminate into mating surfaces (not numbered). This width for peripheral walls 45, 46, 47 and 48 of cover 4 is essentially the same dimension as that of outer peripheral walls 26, 27 and 28 of base 3 and peripheral wall 25 at a–a'. As shown in FIG. 5, peripheral wall 47 has an elongated groove 47*a* along its length for receiving the tongue element 27*a* in peripheral wall 27 of base 3 when base 3 and cover 4 are assembled.

The length of recessed area 50 in outer peripheral wall 45 of cover 4 is about 0.900 inches which is slightly greater than the length of the enlarged area formed by members 29 and 30 in outer peripheral wall 25 of base 3 so that this enlarged area closely fits into recessed area 50, and the length and width of aperture 6 of outer peripheral wall 25 of base 3 are about 0.500 and 0.330 inches, respectively, and handle part 5 fits closely into aperture 6 with very close tolerances therebetween.

The present invention, in addition to barrier member 36 bordering arcuate area 13 of base 3 particularly shown in FIG. 2, involves barrier member 41 particularly shown in FIG. 5. This barrier member 41 generally has an arcuate configuration and is integrally formed in the .inner surface of cover 4. Barrier member 41 is located inwardly of peripheral surface 45 and recessed area 50, and adjacent to arcuate area 40 to border arcuate area 40. Barrier member 41 has a cut-out portion 41*a* which provides a clearance for the handle part 5 and its connection to the remaining components of the circuit breaker mechanism.

The thickness or width of barrier member 41 is less than peripheral walls 45, 46, 47 and 48, and preferably is about 0.156 inches, and may range from about 0.150 inches to about 0.160 inches. FIG. 7, in particular, shows the thickness for barrier member 41 relative to peripheral wall 45.

When the components for the circuit breaker mechanism are assembled into base 3 of FIG. 2, handle part 5 of FIG. 1 is received in arcuate area 13 in aperture 6 with the bearing surface 38*a* on the one side of handle part 5 fitting into circular coring area 37 and handle part 5 projecting from aperture 6 as shown in FIG. 1. Barrier member 36 is spaced away from the circular end of handle part 5 with no interference so that handle part 5 can be pivoted into its operating positionings.

The thickness of the circular end of handle part 5 is greater than that of barrier member 36 so that barrier member 36 overlaps the circular end of handle part 5 with the circular end of handle part 5 being raised above barrier member 36.

Figure 8:
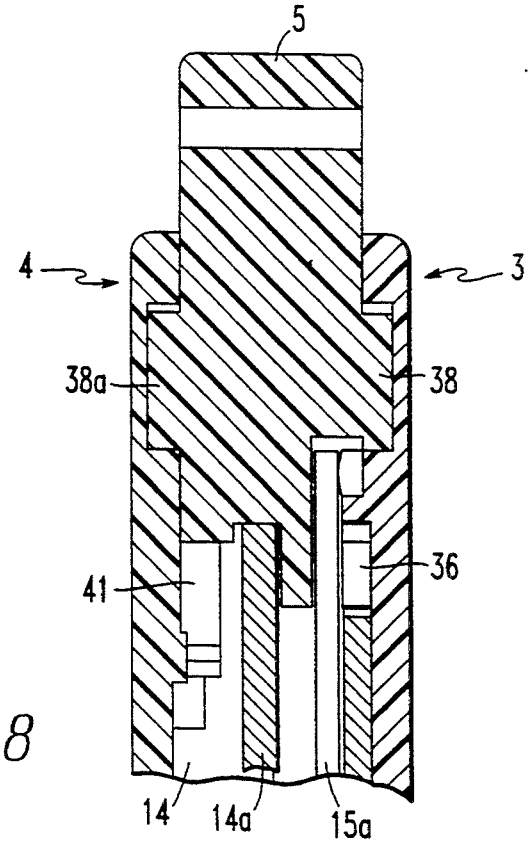
FIG. 8 is an enlarged, fractional cross-sectional view showing the assemblage of the handle part in the base and the cover similar to that of FIG. 1 and showing the barrier members of the present invention relative to the handle part.

When cover 4 of FIG. 5 is assembled onto base 3 in the manner shown in FIG. 1, the opposite bearing side surface 38 of handle part 5 is received in arcuate area 40 and circular coring area 40*a*. Barrier member 41 is spaced away from the circular end of handle part 5 with no interference therebetween. Since the thickness of the circular end of handle part 5 is greater than the width of barrier member 41, barrier member 41 overlaps the circular end of handle part 5 with a gap between the two barrier members 36 and 41 relative to handle part 5. The gap between these barrier members 36 and 41 allow handle part 5 to freely extend down into main cavity 23 for its connection to and operation of the circuit breaker mechanism. FIG. 8 illustrates handle part 5 being received in the assembled base 3 and cover 4 and illustrates the manner in which barrier members 36 and 41 border around the bearing side surface areas 38 and 38*a* of handle part 5 while still allowing handle part 5 to extend freely into inner cavity 23 for its connection to the components of the circuit breaker mechanism, examples of which are indicated by numerals 14*a* and 15*a*.

In this assembling of cover 4 onto base 3, the mating surfaces of peripheral walls 45, 46, 47 and 48 of cover 4 contacts the mating surfaces of peripheral walls 25, 26, 27 and 28 of base 3 with the inner surfaces 51, 52 and 53 of recessed area 50 in outer peripheral wall 45 of cover 4 mating with outer surfaces 34 and 35 of enlarged portions 29 and 30 of base 3. Outer peripheral wall 45 of cover 4 extends across aperture 6 containing handle part 5 to enclose handle part 5 in aperture 6 in a manner similar to that shown in FIG. 1 where there exists a minimum clearance or a clearance of very close tolerances between the handle part 5 of FIG. 1 and recessed area 50 at area d–d' of FIG. 6. Additionally, barrier members 36 and 41 cooperate with handle part 5 to separate aperture 6 from the main inner cavity 23 of the case 2 of FIG. 1 and still allow actuation of the circuit breaker mechanism. It has been shown that the close tolerances of aperture 6 and barrier members 36 and 41 relative to handle part 5 meet the U.L. (Underwriter's Laboratories) requirements in that during testing of the present invention, a cotton swab was placed near aperture 6 and was not set afire when an arc interruption occurred which can result when these tolerances are not close enough.

The overall thickness or width of circuit breaker 1 is about 0.490 or not more than 0.500 inches since peripheral walls 25, 26, 27 and 28 of base 3 are about 0.245, and peripheral walls 45, 46, 47 and 48 of cover 4 are about 0.245.

Being that handle part 5 fits fully into and is adequately supported by aperture 6 in base 3, the components of the circuit breaker mechanism of circuit breaker 1 including the spring biased circuit breaker mechanism can easily be installed and/or mounted into the base, and cover 4 attached thereto. Also, the ribbing system 12 of base 3 and the ribbing system 39 of cover 4 essentially have the same width of 0.245 inches except for barrier members 36 and 41 which have a smaller width, making an overall thickness of less than 0.500 inches for the circuit breaker 1. This provides maximum strength for the circuit breaker 1, which is an important factor when a short circuit occurs, and the barrier members 36 and 41 in cooperation with handle part 5 reduce the escape of gases and/or a flame from the aperture 6 for handle part 5. Both base 3 and cover 4 are formed by a molding process, and are made of either a glass polyester material or a plastic material, and have an equal strength safety factor. Barrier members 36 and 41 are formed in the molding process for base 3 and cover 4, and are therefore preferably made of the same material as base 3 and cover 4. In some instances, barrier members 36 and 41 could be preformed and then attached to base 3 and cover 4. Barrier members 36 and 41 are spaced away from the rounded end of handle part 5 when the circuit breaker mechanism is assembled in the molded case 2. This allows handle part 5 to freely rotate without any interference from barrier members 36 and 41 for operation of the circuit breaker mechanism.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

In accordance with the provisions of the patent statutes, I have explained the principle and operation of my invention and have illustrated and described what consider to be the best embodiment thereof.

I claim:

1. A case for a circuit breaker mechanism having aperture means for receiving and supporting a projected handle part for manual operation of said circuit breaker mechanism, said handle part having a first and a second bearing surface, said case comprising:

a base having an inner surface ribbing system for forming an inner cavity and an inner surface coring means for receiving and supporting said circuit breaker mechanism;

a cover attached to said base and including an inner surface ribbing system which corresponds to and cooperates with said inner surface ribbing system of said base to form and enclose said inner cavity and an inner surface coring means which corresponds to and cooperates with said inner surface coring means of said base for receiving and supporting said circuit breaker mechanism, said ribbing system of said base and said cover including means for forming said aperture means for said receiving of said projected handle part, said coring means of said base including a coring area near said means in said base for forming said aperture means for receiving and supporting said first bearing side of said handle part, and a generally arcuate barrier member formed adjacent to said coring area in said base, said coring means of said cover including a coring area near said means in said cover for forming said aperture means for receiving and supporting said second bearing side of said handle part, and a generally arcuate barrier member formed adjacent to said coring area in said cover, said arcuate barrier member of said base and said arcuate barrier member of said cover being formed to cooperate with said handle part to separate said aperture means from said inner cavity of said case when said cover and said base are assembled, and to allow said handle part to freely extend into said inner cavity for operation of said circuit breaker mechanism.

2. A case according to claim 1, wherein said base and said cover are made by a molding process and wherein said barrier member of said base and said barrier member of said cover are integrally formed.

3. A case according to claim 1, wherein said barrier member of said base has a width of about 0.125 inches.

4. A case according to claim 1, wherein said barrier member of said base has a width ranging from about 0.120 inches to about 0.130 inches.

5. A case according to claim 1, wherein said barrier member of said cover has a width of about 0.156 inches.

6. A case according to claim 1, wherein said barrier member of said base and said barrier member of said cover are spaced away from and overlap said handle part.

7. A case according to claim 1, wherein said barrier member of said cover has a width ranging from about 0.150 inches to about 0.160 inches.

8. A case according to claim 1, wherein said cover and said base are made of glass polyester material, and wherein said barrier member of said cover and said barrier member of said base are integrally formed.

9. A case according to claim 1, wherein said cover and said base are made of a plastic material, and wherein said barrier member of said cover and said barrier member of said base are integrally formed.

10. A case for a circuit breaker mechanism having aperture means for receiving a projected handle part for manual operation of said circuit breaker mechanism, said case comprising:

a base having an inner surface ribbing system for forming inner cavity means for receiving and supporting said circuit breaker mechanism; and a cover attached to said base, and having an inner surface ribbing system which corresponds to and cooperates with said inner surface ribbing system of said base to form and enclose said inner cavity means, said ribbing system of said base and said cover including means for forming said aperture means for said receiving and supporting said projected handle part, said base further including a first barrier member near said aperture means, said cover further including a second barrier member near said aperture means, and said first barrier member and said second barrier member being formed to cooperate with said handle part to separate said aperture means from said inner cavity means of said case when said cover and said base are assembled and to allow said handle part to freely extend into said inner cavity for operation of said circuit breaker mechanism.

11. A case according to claim 10, wherein said base and said cover are made by a molding process, and wherein said first barrier member and said second barrier member are integrally formed.

12. A case according to claim 10, wherein said first barrier member has a width of about 0.125 inches.

13. A case according to claim 10, wherein said first barrier member has a width ranging from about 0.120 inches to about 0.130 inches.

14. A case according to claim 10, wherein said second barrier member has a width of about 0.156 inches.

15. A case according to claim 10, wherein said second barrier member has a width ranging from about 0.150 inches to about 0.160 inches.

16. A case according to claim 10, wherein said first barrier member and said second barrier member are spaced away from and overlap said handle part.

17. A case according to claim 10, wherein said base and said cover are made of glass polyester material, and wherein said first barrier member and said second barrier member are integrally formed.

18. A case according to claim 10, wherein said base and said cover are made of a plastic material, and wherein said first barrier member and said second barrier member are integrally formed.

* * * * *